US007672629B2

(12) United States Patent
Okada

(10) Patent No.: US 7,672,629 B2
(45) Date of Patent: Mar. 2, 2010

(54) SHEET PROCESSING APPARATUS, FIXING UNIT AND IMAGE FORMING APPARATUS PROVIDED WITH THE FIXING UNIT

(75) Inventor: Seiji Okada, Osaka (JP)

(73) Assignee: Kyocera Mita Corporation (JP)

( * ) Notice: Subject to any disclaimer, the term of this patent is extended or adjusted under 35 U.S.C. 154(b) by 135 days.

(21) Appl. No.: 11/945,302

(22) Filed: Nov. 27, 2007

(65) Prior Publication Data

US 2008/0124141 A1 May 29, 2008

(30) Foreign Application Priority Data

Nov. 29, 2006 (JP) ..... 2006-322110

(51) Int. Cl.
*G03G 15/20* (2006.01)

(52) U.S. Cl. ..... 399/323; 271/307

(58) Field of Classification Search ..... 399/323, 399/322, 328, 329, 398, 399; 271/307, 311, 271/312

See application file for complete search history.

(56) References Cited

U.S. PATENT DOCUMENTS 4,062,534 A * 12/1977 Sasahara ..... 399/323 X
6,678,497 B1 * 1/2004 Murata ..... 399/323
6,795,676 B2 * 9/2004 Kikuchi et al. ..... 399/323
2003/0081970 A1 * 5/2003 Yamamoto et al. ..... 399/323
2005/0008409 A1 * 1/2005 Kurisu ..... 399/323
2005/0084302 A1 * 4/2005 Masuda et al. ..... 399/322
2005/0220506 A1 * 10/2005 Nakayama ..... 399/323

FOREIGN PATENT DOCUMENTS

JP 2004-102241 4/2004

* cited by examiner

*Primary Examiner*—Sophia S Chen
(74) *Attorney, Agent, or Firm*—Gerald E. Hespos; Anthony J. Casella

(57) ABSTRACT

A fixing unit includes a heating rotary member for heating a sheet, a pressing rotary member that is pressed against the heating rotary member with a specific pressure, forming a nip in between, and at least one separating member having a far end directed toward a surface of one of the rotary members with a narrow gap (d) on a downstream side of the nip so that the far end of the separating member hooks on and separates the sheet which is going to turn with the one rotary member. The gap (d) between the far end of said separating member and the surface of the one rotary member and a minimum width (L) of a top margin of the sheet along a leading edge thereof where the toner image is not formed are set to satisfy a relationship expressed by the inequality:

$d+1.5 \leqq L \leqq 3d+1.5.$

15 Claims, 11 Drawing Sheets

| NO. OF PLATES | x | y | r |
|---|---|---|---|
| 6 | 7.0 | 4.4 | 8.3 |
| 9 | 5.8 | 3.1 | 6.5 |
| 11 | 5.0 | 2.3 | 5.5 |
| 12 | 4.4 | 1.9 | 4.8 |
| 13 | 4.0 | 1.5 | 4.3 |
| 14 | 3.5 | 1.2 | 3.7 |
| 15 | 3.0 | 0.9 | 3.1 |

SHEET PROCESSING APPARATUS, FIXING UNIT AND IMAGE FORMING APPARATUS PROVIDED WITH THE FIXING UNIT

BACKGROUND OF THE INVENTION

1. Field of the Invention

The present invention relates to a fixing unit provided with a separating member capable of properly separating a sheet carrying a fixed toner image from a fixing roller as well as to an image forming apparatus and a sheet processing apparatus.

2. Description of the Related Art

Image forming apparatuses, such as copying machines, printers and facsimile machines, generally employ a heat-and-pressure type fixing unit for fixing a toner image onto a sheet. This type of fixing unit is configured so that a pressure roller is pressed against a fixing roller heated by a heater to create a fixing nip portion between the two rollers. As a sheet carrying an unfixed toner image is passed through the fixing nip portion, the fixing unit applies heat and pressure to the toner image to fix the same to the sheet. Since the toner image fixed onto the sheet acts like glue, the sheet carrying the fixed toner image is apt to turn with the fixing roller. To prevent this inconvenience, the fixing unit is provided with a separating member of which one end hooks on a leading edge of the sheet to separate the sheet from a surface of the fixing roller.

Japanese Unexamined Patent Publication No. 2004-102241 describes a technique for separating a sheet from a surface of a fixing roller by means of a separating member (stripping plate). Expressing a distance between a downstream end of a fixing nip portion and a far end of the separating member by r and a minimum width of a top margin of a sheet formed along a leading edge thereof by L, the separating member of this Publication is disposed to satisfy the following relationship:

$$r \leqq L$$

Although the aforementioned Patent Publication shows an arrangement in which a gap K between the far end of the separating member and the surface of the fixing roller is as narrow as 0.5 mm, there is no mention of a case where this gap K is smaller than 0.5 mm in the Publication.

There is a growing tendency today to employ a fixing roller having a rubber layer with a reduced thickness for achieving chiefly a reduction in warm-up time of a color image forming apparatus, for example. The reduction in the thickness of the rubber layer tends to cause a reduction in elasticity of the entire fixing roller, resulting in a loss in sheet separating capability of the apparatus. Also, increased processing speed of an image forming apparatus could cause sheet transfer problems or registration errors, thus producing variations in the width of the top margin. Should this situation occur, it might be necessary to set the aforementioned gap K below 0.5 mm.

According to the above-cited Patent Publication, the far end of the separating member must be at a distance of 1 mm or less from the downstream end of the fixing nip portion when the top margin of the sheet is approximately 1 mm, for instance. In such a case, the separating member is located so close to a sheet transfer path that the separating member may interfere with the sheet being transferred, causing a jam. Although it is preferable to locate the separating member at some distance from the sheet transfer path to prevent jams, there arises a problem that the width of the top margin increases if the separating member is so located.

SUMMARY OF THE INVENTION

It is an object of the invention to provide a fixing unit which can reliably separate a sheet carrying a fixed toner image even when variations occur in the width of a top margin of the sheet, as well as an image forming apparatus including such a fixing unit, and a sheet processing apparatus.

According to a first aspect of the invention, a fixing unit comprises a heating rotary member for heating a sheet, a pressing rotary member which is pressed against the heating rotary member with a specific pressure, forming a nip portion in between, and at least one separating member having a far end directed toward a surface of one of the rotary members with a narrow gap d on a downstream side of the nip portion so that the far end of the separating member hooks on and separates the sheet which is going to turn with the aforementioned one of the rotary members. In this fixing unit of the invention, the gap d (mm) between the far end of the separating member and the surface of the aforementioned one of the rotary members and a minimum width L (mm) of a top margin of the sheet along a leading edge thereof where no toner image is formed are set to satisfy a relationship expressed by the following inequality:

$$d+1.5 \leqq L \leqq 3d+1.5.$$

According to a second aspect of the invention, an image forming apparatus comprises a sheet transport section for transporting a sheet, an image forming section for forming a toner image on the sheet transported by the sheet transport section, and a fixing section for partially melting and fixing the toner image formed on the sheet by the image forming section to a surface of the sheet by application of heat and pressure, wherein the fixing section in configured in the same fashion as the aforementioned fixing unit according to the first aspect.

According to a third aspect of the invention, a sheet processing apparatus for partially melting and fixing a thin layer of a hot-melt material formed on a surface of a sheet to the surface of the sheet by application of heat and pressure comprises first and second rotary members which are pressed against each other with a specific pressure, forming a nip portion in between, whereby the first and second rotary members together pass the sheet through the nip portion while heating and pressing the sheet, and at least one separating member having a far end directed toward a surface of one of the first and second rotary members with a narrow gap d on a downstream side of the nip portion so that the far end of the separating member hooks on and separates the sheet which is going to turn with the aforementioned one of the first and second rotary members. In this sheet processing apparatus of the invention, the gap d (mm) between the far end of the separating member and the surface of the aforementioned one of the first and second rotary members and a minimum width L (mm) of a top margin of the sheet along a leading edge thereof where the thin layer of the hot-melt material is not formed are set to satisfy a relationship expressed by the following inequality:

$$d+1.5 \leqq L \leqq 3d+1.5.$$

The foregoing and other objects, features, aspects and advantages of the present invention will become more apparent from the following detailed description when read in conjunction with the accompanying drawings.

DETAILED DESCRIPTION OF THE PREFERRED EMBODIMENTS

Figure 1:
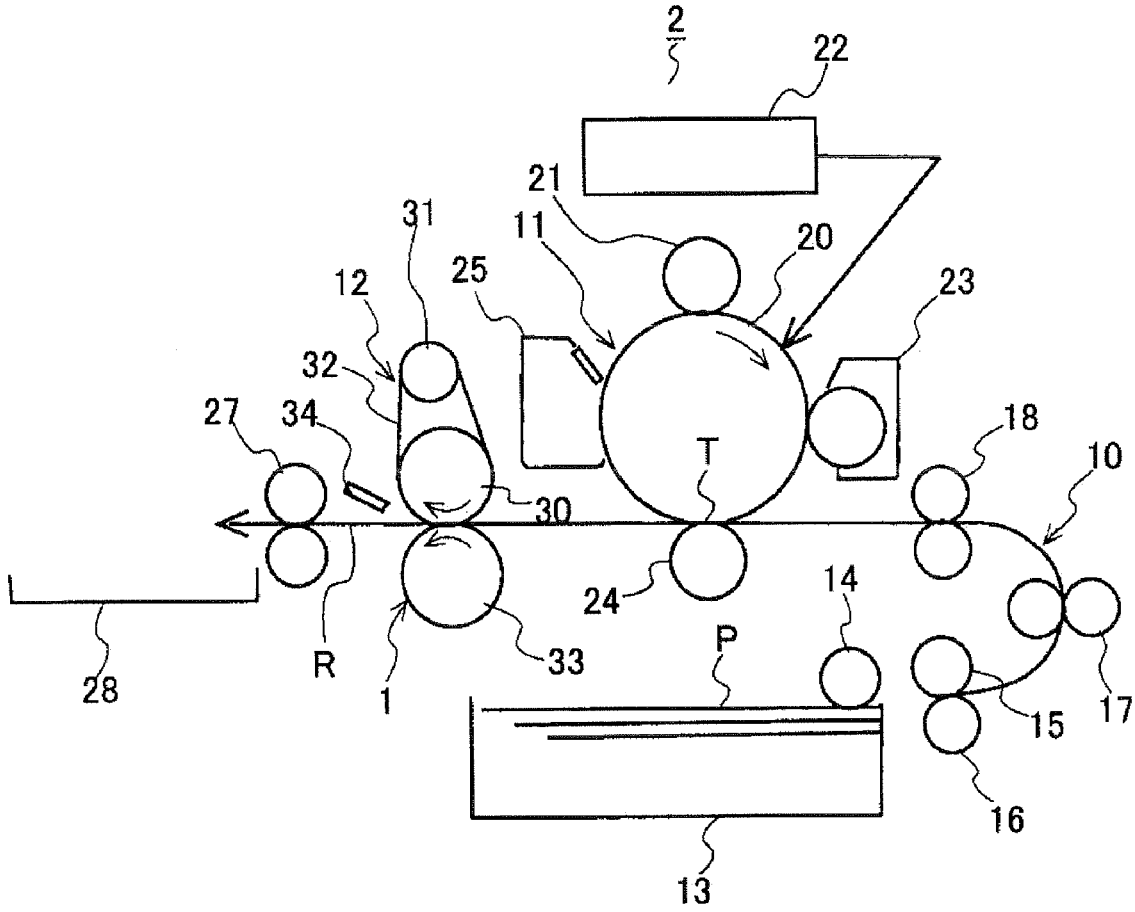
FIG. 1 is a diagram schematically showing the construction of an image forming apparatus provided with a fixing unit according to a preferred embodiment of the invention.

Specific embodiments of the present invention are now described in detail with reference to the accompanying drawings, in which elements designated by like symbols have essentially the same structure and a description of such elements will not be repeated. Also, elements which need not be described in explaining the invention are not illustrated in the drawings.

Figure 2:
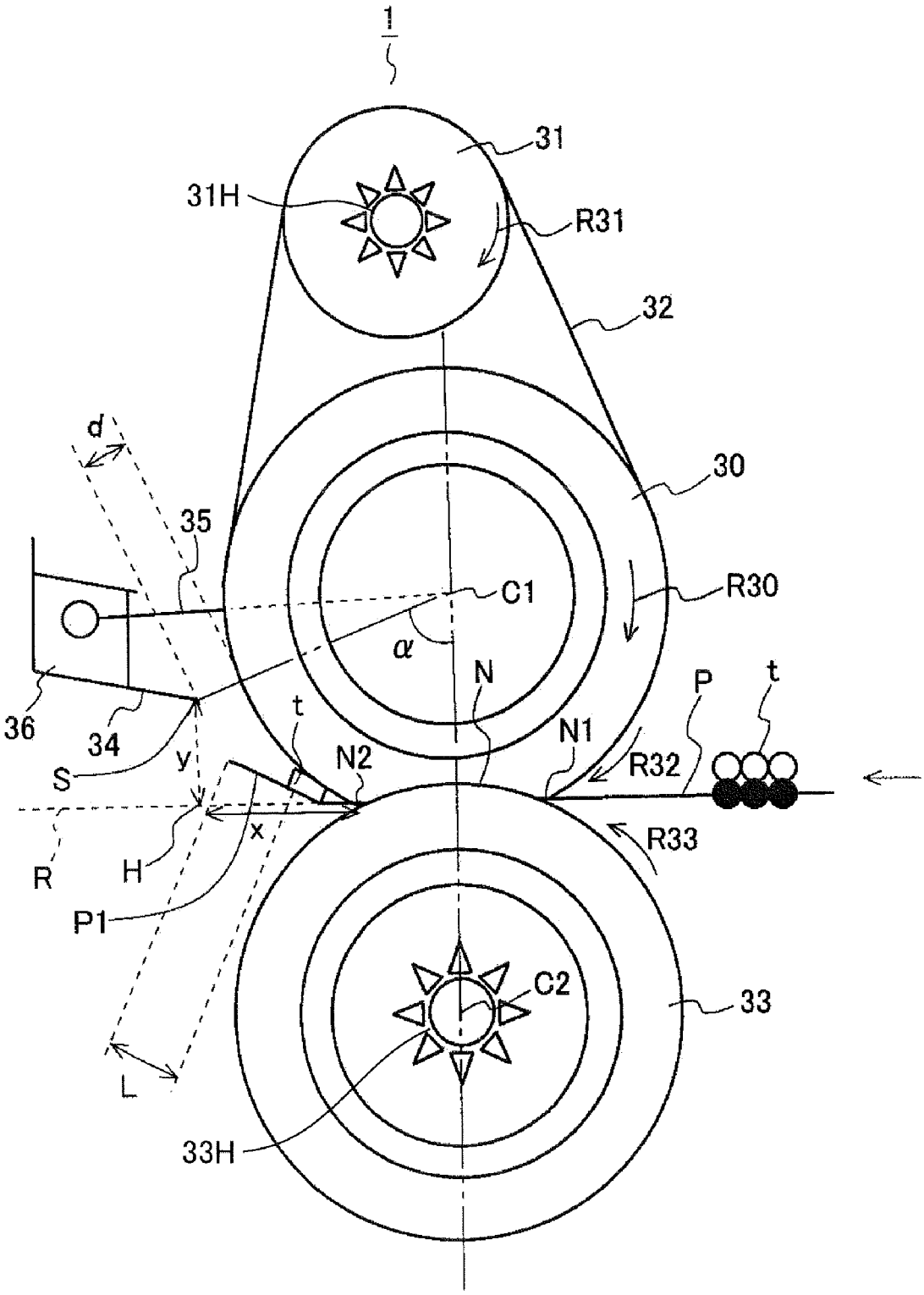
FIG. 2 is an enlarged schematic diagram showing an example of the fixing unit of the embodiment.
Figure 3:
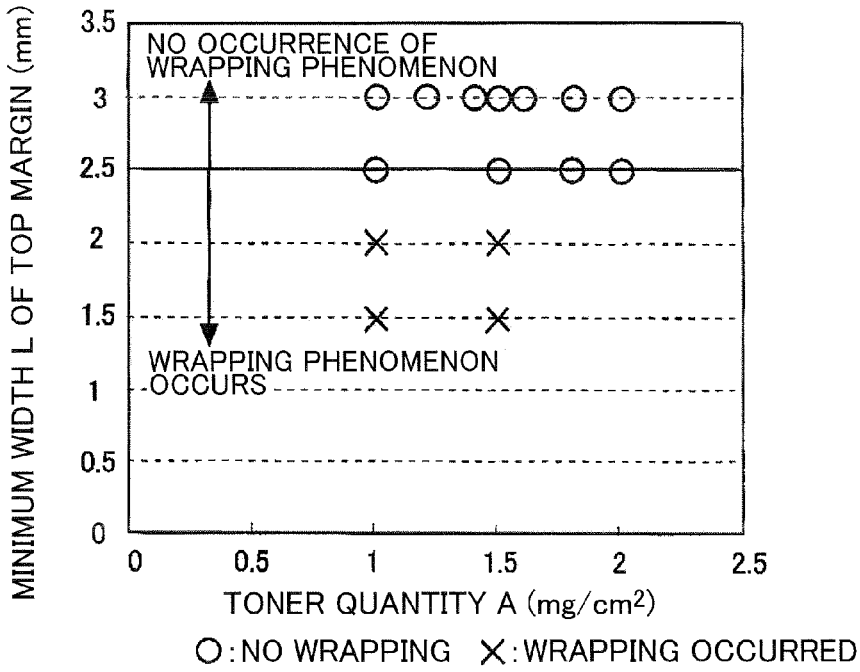
FIG. 3 is a diagram showing results of an experiment conducted to see whether a "wrapping" phenomenon of a sheet occurs when toner quantity and a minimum width of a top margin of the sheet as measured along a feed direction thereof are varied.
Figure 4:
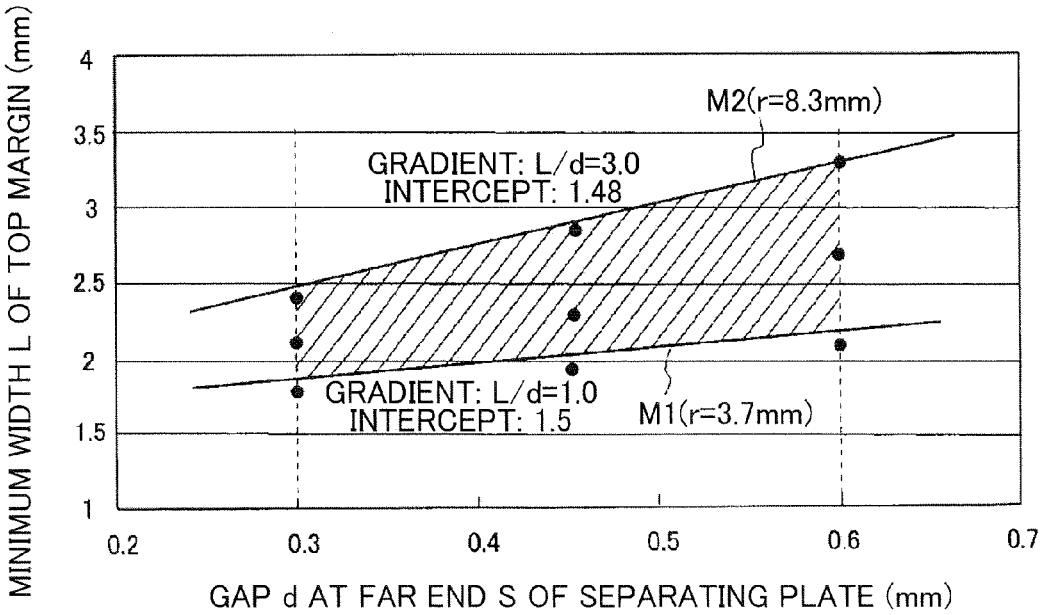
FIG. 4 is a diagram showing results of an experiment conducted to see whether the wrapping phenomenon of the sheet occurs when a gap between a far end of a separating plate and a surface of a fixing belt and the minimum width of the top margin of the sheet are varied.
Figure 5:
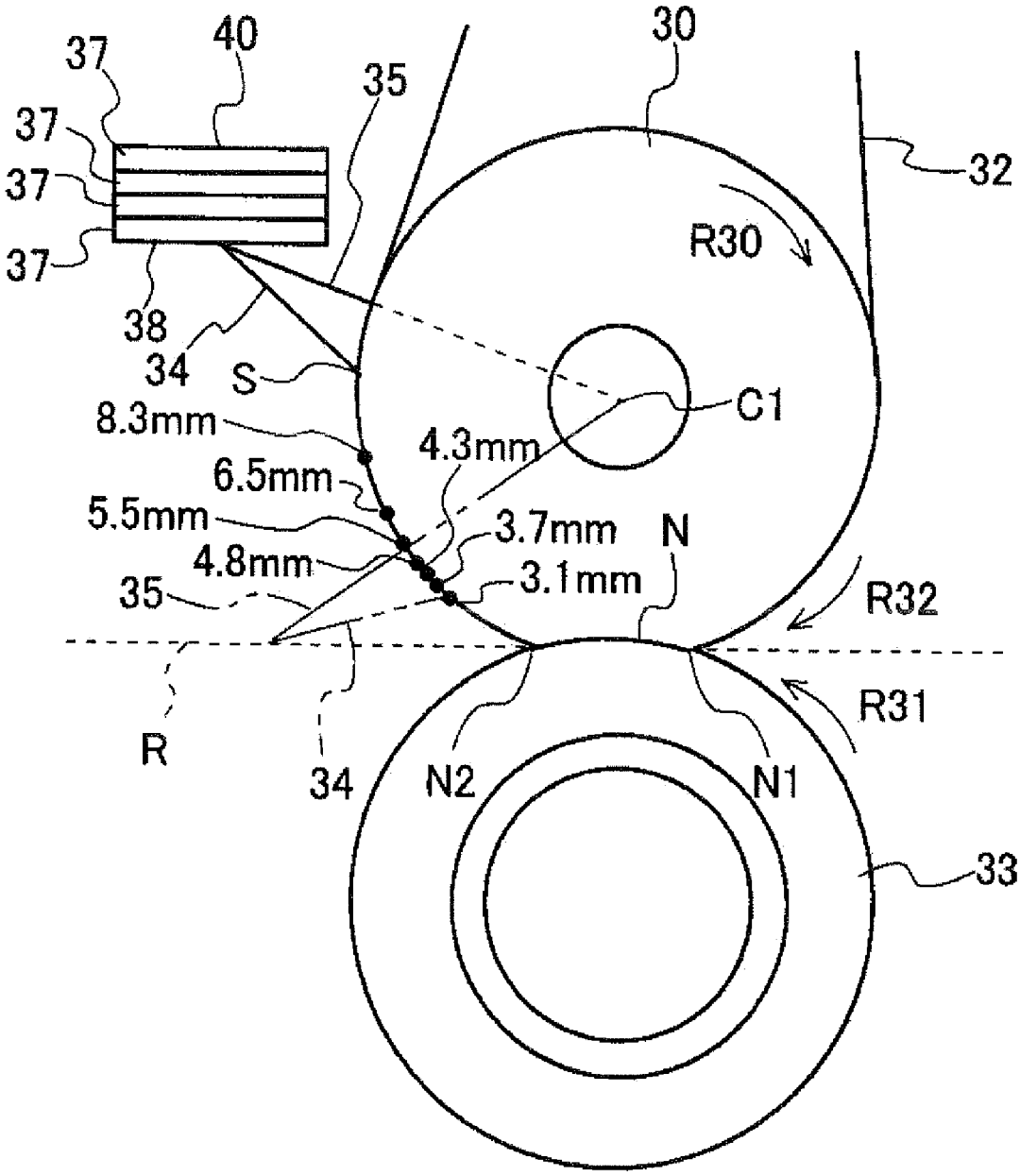
FIG. 5 is a diagram showing how the far end of the separating plate is located in relation to the fixing belt.
Figures 6, 7:
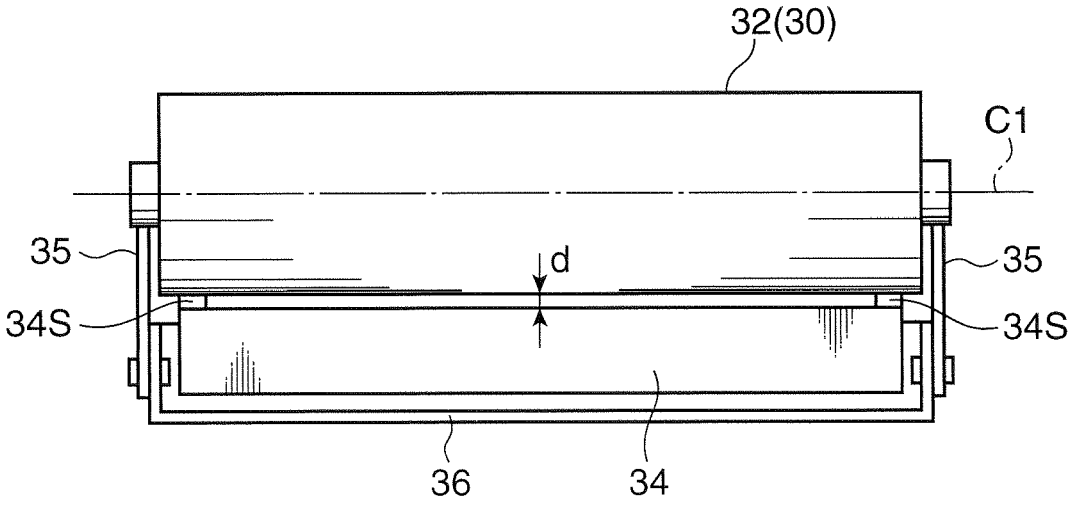
FIG. 6 is a chart showing a relationship between the number of plates for varying the location of the far end of the separating plate and a distance from a downstream end of a fixing nip portion to the far end of the separating plate.
FIG. 7 is a schematic top view of the fixing unit of the embodiment.

Referring to FIGS. 1 to 6, a fixing unit 1 according to a preferred embodiment of the invention is described below. FIG. 1 is a diagram schematically showing the construction of an image forming apparatus 2 provided with the fixing unit 1 of the embodiment. FIG. 2 is an enlarged schematic diagram showing an example of the fixing unit 1 of the embodiment. FIG. 3 is a diagram showing results of an experiment conducted to see whether a "wrapping" phenomenon of a sheet P occurs when toner quantity A and a minimum width L of a top margin P1 of the sheet P as measured along a feed direction thereof are varied. FIG. 4 is a diagram showing results of an experiment conducted to see whether the wrapping phenomenon of the sheet P occurs when a gap d between a far end S of a separating plate (separating member) 34 and a surface of a fixing belt 32 and the minimum width L of the top margin P1 of the sheet P are varied. FIG. 5 is a diagram showing how the far end S of the separating plate 34 is located in relation to the fixing belt 32. FIG. 6 is a chart showing a relationship between the number of plates 37 for varying the location of the far end S of the separating plate 34 and a later-described distance r. FIG. 7 is a schematic top view of the fixing unit 1 of the embodiment.

As depicted in FIG. 1, the image forming apparatus 2 includes a sheet transport section 10, an image forming section 11 and a fixing section 12. The sheet transport section 10 is so configured that a pickup roller 14 picks up and feeds successive sheets P stacked in a paper cassette 13, and a feed roller 15 and a retard roller 16 together serve to separate and feed a single sheet P at a time. Transported further downstream by a pair of transport rollers 17, the sheet P is forced against a pair of registration rollers 18 at rest, whereby the sheet P, if obliquely fed, is correctly positioned.

The image forming section 11 includes a photosensitive drum 20, a static charging roller 21 for uniformly charging a curved outer surface of the photosensitive drum 20, an exposure unit 22 for exposing the outer surface of the photosensitive drum 20 according to input image information to create an electrostatic latent image thereon, a developing unit 23 for supplying toner particles onto the outer surface of the photosensitive drum 20 to convert the latent image into a visible toner image, an image transfer roller 24 for transferring the toner image from the photosensitive drum 20 to the sheet P by applying a bias voltage to the sheet P, and a cleaning unit 25 for cleaning the outer surface of the photosensitive drum 20.

The image forming section 11 is so configured that the static charging roller 21 charges the outer surface of the photosensitive drum 20 rotating in an arrow direction (FIG. 1) to a specific potential in a predefined polarity. The exposure unit 22 exposes the charged outer surface of the photosensitive drum 20 according to the input image information to create an electrostatic latent image as mentioned above. In the developing unit 23, toner particles supplied onto the outer surface of the photosensitive drum 20 adhere to the latent image, thereby developing a toner image t.

As the photosensitive drum 20 rotates, the toner image t is carried to an image transfer nip portion T formed between the photosensitive drum 20 and the image transfer roller 24. Synchronized with this timing, the registration roller pair 18 feeds the sheet P to the image transfer nip portion T so that the image transfer roller 24 transfers the toner image t onto the sheet P.

After the toner image t is transferred onto the sheet P, the cleaning unit 25 removes residual toner particles left on the outer surface of the photosensitive drum 20 in preparation for a succeeding image forming job. On the other hand, the toner image t transferred onto the sheet P is fixed to the sheet P by the fixing unit 1 provided in the fixing section 12. The fixing unit 1 will be described in detail in the following paragraphs. Then, the sheet P carrying the fixed toner image t is discharged onto a delivery tray 28 by a pair of output rollers 27. At this point, the image forming job for producing an image on one side of the single sheet P is completed.

FIG. 2 specifically shows the construction of the heat-and-pressure type fixing unit 1 which applies heat and pressure to the sheet P carrying the unfixed toner image t so that the toner image t partially melts and sticks to the sheet P. The fixing unit 1 includes a fixing roller 30 having elasticity, a heating drive roller 31 incorporating a heater 31H serving as a heating element, the earlier-mentioned fixing belt (heating rotary member) 32 mounted on the fixing roller 30 and the heating drive roller 31, and a pressure roller (pressing rotary member) 33 incorporating a heater 33H serving as another heating element which is forced against the fixing belt 32 from underneath. While the pressure roller 33 rotates by itself with an externally input driving force, the pressure roller 33 is also driven to rotate by the fixing belt 32 which is in direct contact with the pressure roller 33.

Between the fixing belt 32 and the pressure roller 33, there is formed a strip-shaped fixing nip portion N which is elongate along an axial direction of the fixing roller 30 (or along a direction perpendicular to the feed direction of the sheet P). The fixing nip portion N has an upstream end N1 located upstream along the feed direction of the sheet P and a downstream end N2 located downstream, with a nip formed between the upstream end N1 and the downstream end N2. As the heating drive roller 31 is driven in the direction of an arrow R31 shown in FIG. 2, the fixing belt 32, the fixing roller 30 and the pressure roller 33 rotate in directions shown by arrows R32, R30 and R33, respectively.

The fixing roller 30, the pressure roller 33 and the fixing belt 32 employed in this embodiment are structured as mentioned below, for example. Specifically, the fixing roller 30 is a silicone sponge roller with a diameter of 32 mm having an Asker C hardness of 30 degrees. The pressure roller 33 is a solid silicone roller having an Asker C hardness of 50 degrees covered with a perfluoroalkoxy (PFA) tube. The fixing belt 32 is an endless belt made of a nickel-based material with a 300-μm thick silicone rubber coating covered with a PFA tube.

As already mentioned, the sheet P has the top margin P1 in which the toner image t is not formed along a leading edge of the sheet P. The top margin P1 is formed all across the sheet P (perpendicular to the feed direction) slightly downward from the leading edge. The fixing unit 1 of this embodiment includes the aforementioned separating plate (separating member) 34. The sheet P carrying the fixed toner image t tends to turn with the moving fixing belt 32. To prevent this, the far end S of the separating plate 34 is inserted between the top margin P1 of the sheet P and the fixing belt 32 to separate the sheet P from the fixing belt 32.

The separating plate 34 is a platelike member as depicted in FIGS. 2 and 7. Specifically, the separating plate 34 is a metal plate made of SUS- or SUM-type steel, for instance, and the far end S and a surface of the separating plate 34 facing a sheet transfer path R (refer to FIG. 2) are covered with such an element as a fluorine coating or a polytetrafluoroethylene (PTFE) tape which exhibits an excellent release characteristic. Described below is how the distance r from the downstream end N2 of the fixing nip portion N to the far end S of the separating plate 34 is calculated.

The separating plate 34 of this embodiment is supported by a pair of supporting arms 35 of which supporting ends are mounted on a central axis C1 of a bearing (a central axis of the fixing roller 30) rotatably supporting the fixing roller 30 so that the supporting arms 35 can swing about the central axis C1. The separating plate 34 is retained by a holder 36 which is attached to outer ends of the supporting arms 35. This arrangement (adjustment mechanism) of the embodiment permits the far end S of the separating plate 34 to move (or turn about the central axis C1) along a curved outer surface of the fixing roller 30.

In this arrangement, the location of the far end S of the separating plate 34 is determined by an angle α formed between a straight line connecting the central axis C1 of the fixing roller 30 and a central axis C2 of the pressure roller 33 and a straight line connecting the central axis C1 of the fixing roller 30 and the far end S of the separating plate 34. Designated by the letter H in FIG. 2 is a point of intersection of a vertical line drawn from the far end S of the separating plate 34 and the sheet transfer path R passing through the upstream end N1 and the downstream end N2 of the fixing nip portion N. Expressing a distance from the downstream end N2 of the fixing nip portion N to the intersection point H by x and a distance from the far end S of the separating plate 34 to the intersection point H by y, the aforementioned distance r from the downstream end N2 of the fixing nip portion N to the far end S of the separating plate 34 is given by equation (1) below:

$$r=(x^2+y^2)^{1/2} \quad (1)$$

Figure 14A:
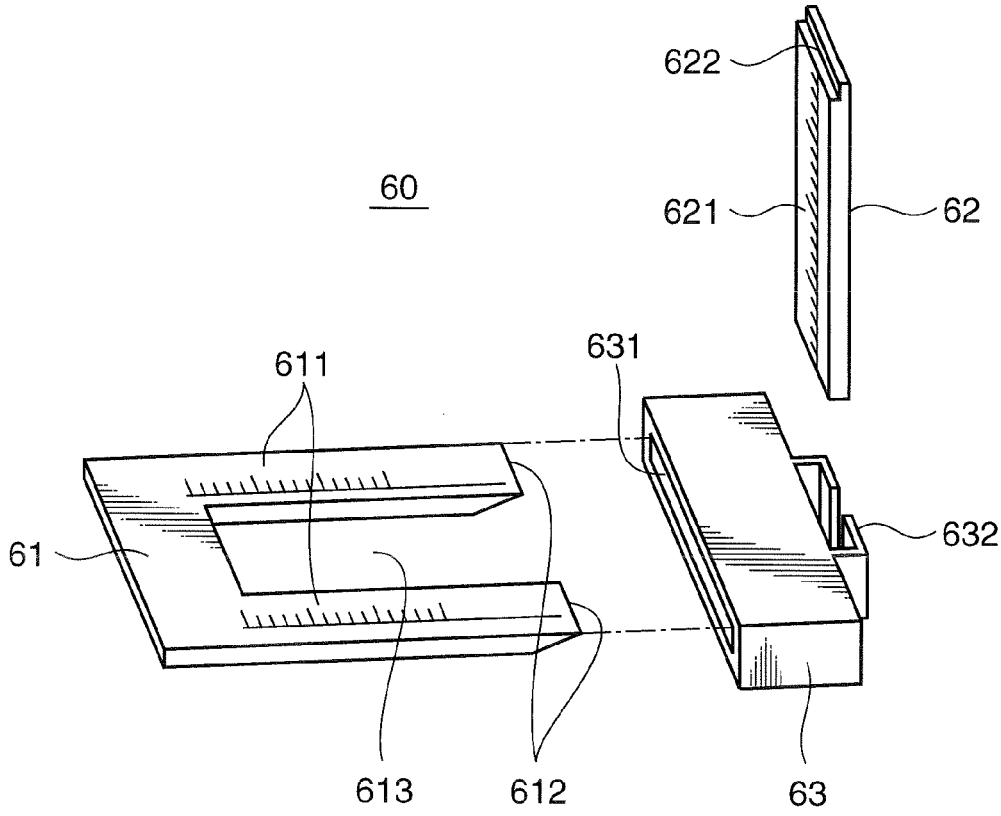
FIG. 14A is an exploded perspective view of a measuring jig for measuring distances.
Figure 14B:
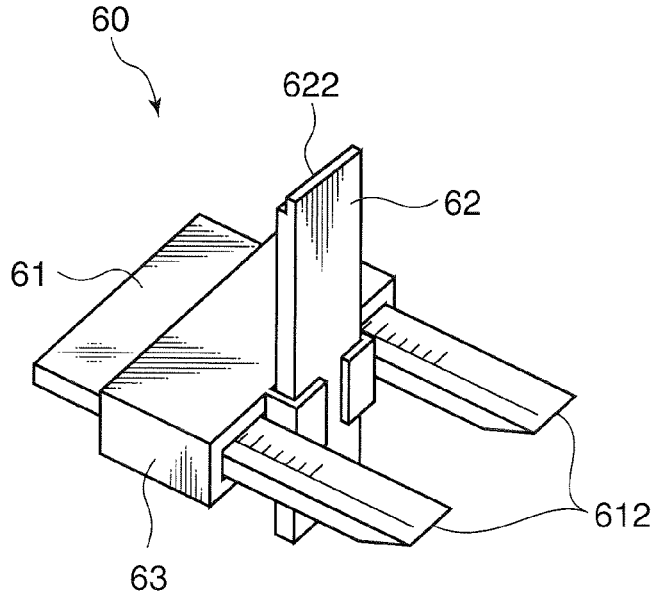
FIG. 14B is a perspective view of the measuring jig in an assembled state.

An example of a jig for measuring the aforementioned distances x and y and a method of measurement using the jig are described below. FIG. 14A is an exploded perspective view of a measuring jig 60 for measuring the distances x and y, and FIG. 14B is a perspective view of the measuring jig 60 in an assembled state. As shown in these Figures, the measuring jig 60 includes an X scale 61, a Y scale 62 and a retainer 63.

The X scale 61 is a generally U-shaped platelike member having marks 611 used as a reference in measurement in an x-direction and wedge-shaped ends 612 formed by shaping ends of two arms of the X scale 61 into a wedgelike form. The Y scale 62 is a generally rectangular platelike member having marks 621 used as a reference in measurement in a y-direction and a supporting portion 622 formed by shaping an upper end of the Y scale 62 into a thicknesswisely stepped form. The retainer 63 slidably holds the X scale 61 and the Y scale 62 while keeping the two scales 61, 62 perpendicular to each other. The retainer 63 has a first retaining part 631 in which the X scale 61 is fitted and a second retaining part 632 in which the Y scale 62 is fitted. A central empty space 613 of the X scale 61 is provided to prevent the X scale 61 from interfering with the Y scale 62 and the second retaining part 632.

Figure 15:
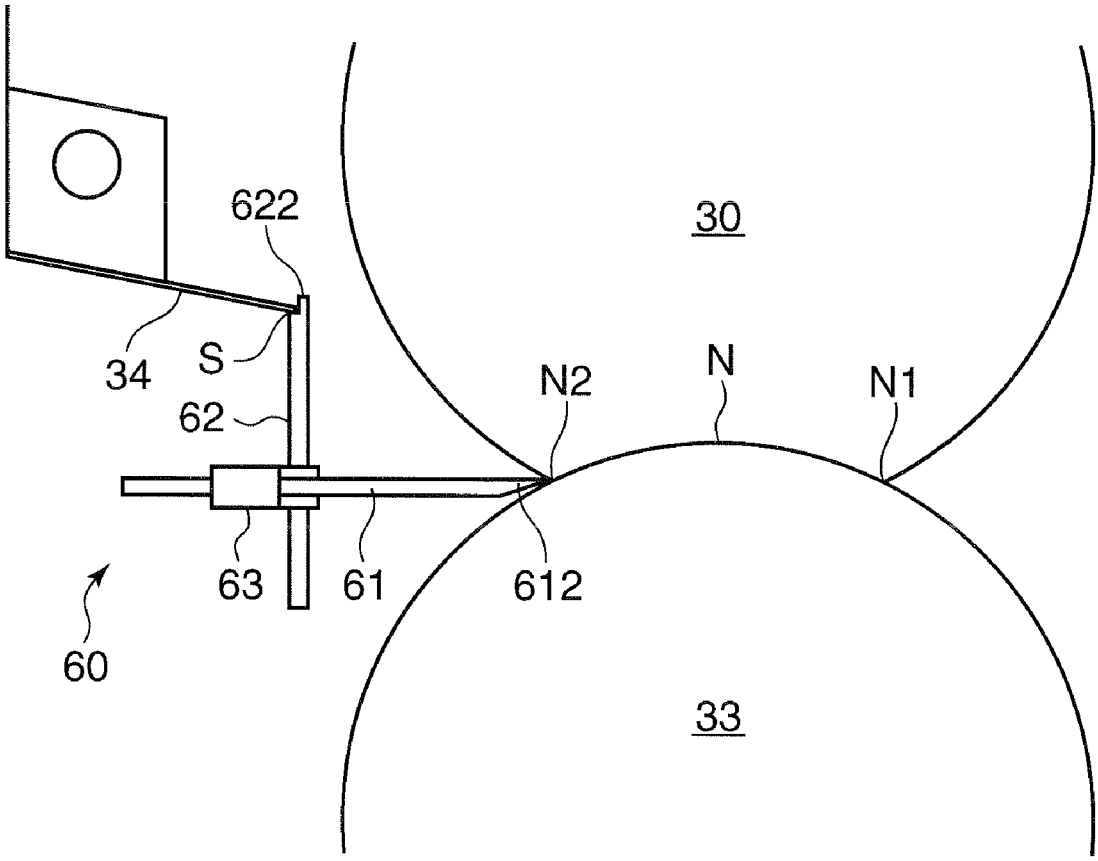
FIG. 15 is a diagram showing how the measuring jig is used when measuring the distances.

FIG. 15 is a diagram showing how the measuring jig 60 is used when measuring the distances x and y. The X scale 61 is placed along the sheet transfer path R with the wedge-shaped ends 612 pressed lightly against the downstream end N2 of the fixing nip portion N. On the other hand, the Y scale 62 is positioned such that the far end S of the separating plate 34 fits on the stepped supporting portion 622 of the Y scale 62. To position the measuring jig 60 in close contact with the downstream end N2 of the fixing nip portion N and the far end S of the separating plate 34, a worker slides the X scale 61 and the Y scale 62 along the retainer 63. After correctly positioning the measuring jig 60 in the aforementioned manner, the worker can read the distances x and y on the marks 611 and 621 on the X scale 61 and the Y scale 62, respectively.

FIG. 5 shows an arrangement used in conducting an experiment to see whether the wrapping of the sheet P carrying the fixed toner image t occurs at different values of the distance r from the downstream end N2 of the fixing nip portion N to the far end S of the separating plate 34. In this experiment, the gap d between the far end S of the separating plate 34 and the surface of the fixing belt 32 was set to a specified value (e.g., 0.5 mm). During execution of the experiment, the gap d was kept at the specified value by inserting spacers 34S having a thickness d between the far end S of the separating plate 34 and the fixing belt 32 at both lateral ends of the separating plate 34 as shown in FIG. 7.

When the supporting arms 35 turn about the central axis C1 of the fixing roller 30, the separating plate 34 supported by the supporting arms 35 also turns about the central axis C1 while keeping a specific posture relative to the supporting arms 35. Therefore, it is possible to vary the aforementioned distance r by moving the separating plate 34 parallel to the surface of the fixing belt 32 while keeping the constant gap d between the far end S of the separating plate 34 and the surface of the fixing belt 32. In the arrangement shown in FIG. 5, the distance r is varied by altering the number of plates 37.

There is provided a plate holder 38 at a basal part of the separating plate 34 along the direction perpendicular to the feed direction of the sheet P. The plate holder 38 is configured such that a plurality of plates 37 can be stacked one on top of another on a top surface of the plate holder 38 and the plate holder 38 always remains in a horizontal position even when the location of the separating plate 34 is altered.

The plate holder 38 is biased toward a reference member 40 disposed at a fixed position by means of a biasing element (not shown). With this arrangement, the plate holder 38 is biased upward so that a top surface of the uppermost one of the plates 37 stacked on the plate holder 38 is forced against the reference member 40 from underneath. Therefore, as the number of plates 37 stacked on the plate holder 38 increases, the plate holder 38 is located progressively lower and the far end S of the separating plate 34 moves parallel to the surface of the fixing belt 32 accordingly.

FIG. 6 shows the relationship between the number of plates 37 and the distance r which is determined by measuring the aforementioned distances x and y and substituting the same in equation (1) above. As shown in FIG. 6, the distance r from the downstream end N2 of the fixing nip portion N to the far end S of the separating plate 34 decreases when the number of plates 37 is increased.

More specifically, as the number of plates 37 is increased from 6 to 9, 11, 12, 13, 14 and 15, the distance r decreases in successive steps from 8.3 mm to 6.5 mm, 5.5 mm, 4.8 mm, 4.3 mm, 3.7 mm and 3.1 mm. Small dots shown in FIG. 5 indicate positions corresponding to these values of the distance r plotted along the surface of the fixing belt 32. Although the far end S of the separating plate 34 is located slightly apart from the surface of the fixing belt 32 in actuality, the location of the far end S of the separating plate 34 is plotted on the surface of the fixing belt 32 in FIG. 5 for the convenience of explanation. The experiment was conducted to see whether the wrapping phenomenon would occur assuming that the far end S of the separating plate 34 was located at the plotted dots shown in FIG. 5, and this experiment produced the following results.

When the distance r was 3.1 mm (with 15 plates 37) or less, part of the separating plate 34 went beyond the sheet transfer path R as shown by alternate long and two short dashed lines in FIG. 5 and, as a result, the sheet P hit against the separating plate 34, causing a jam. This kind of jam did not occur when the distance r was 3.7 mm (with 14 plates 37) or above.

When the distance r exceeded 8.3 mm (with 6 plates 37), however, the toner image t exhibited uneven gloss. When the distance r exceeds 8.3 mm, the far end S of the separating plate 34 is located far away from the fixing nip portion N, so that the fixing roller 30 imparts excess heat to the toner image t on the sheet P which is transported with a tendency to wrap around the fixing belt 32. Consequently, the toner image t fixed onto the sheet P produces a somewhat rough finish and uneven gloss. A period of time required for a portion of the sheet P where the toner image t was formed to reach the position corresponding to r=8.3 mm after passing the downstream end N2 of the fixing nip portion N was 54 ms according to a calculation based on a turning speed of the fixing belt 32.

Considering the aforementioned experimental results, the inventor attempted to find out preferable values of such parameters as the minimum width L of the top margin P1 of the sheet P and the gap d between the far end S of the separating plate 34 and the surface of the fixing belt 32 within the following range of the distance r:

$$3.7 \leqq r \leqq 8.3 \quad (2)$$

The sheet P transported up to the fixing unit 1 carrying the unfixed toner image t is passed through the fixing nip portion N where heat and pressure are applied to the sheet P, whereby the toner image t partially melts and sticks to the sheet P. The fixed toner image t acts like glue, causing the sheet P to adhere to the fixing belt 32, so that the sheet P carrying the fixed toner image t has a tendency to wrap around the fixing belt 32.

FIG. 3 is a graphical representation of the experimental results concerning the occurrence of the wrapping phenomenon in relation to the toner quantity A (mg/cm$^2$) shown on a horizontal axis and the minimum width L (mm) of the top margin P1 of the sheet P shown on a vertical axis. The experiment was conducted with the gap d between the far end S of the separating plate 34 and the surface of the fixing belt 32 set to 0.5 mm (d=0.5 mm). In executing the experiment, the image forming apparatus 2 was so prepared as to print a solid image in a specified printing area of an A4-size sheet P in portrait format (with the long sides aligned with the feed direction), leaving a blank space (top margin P1) along the leading edge. In the context of the present Specification, "wrapping" refers to a situation in which the sheet P wraps around the fixing belt 32 as well as to a situation in which the leading edge of the sheet P becomes bent, causing a sheet separation failure.

The toner quantity A was varied from 1.0 mg/cm$^2$ to 2.0 mg/cm$^2$ in several steps as shown in FIG. 3 to see whether the wrapping of the sheet P would occur. The experimental results indicated that the width of the top margin P1 was more influential than the toner quantity A on the occurrence of the wrapping phenomenon. Specifically, the wrapping phenomenon occurred regardless of the toner quantity A when the minimum width L of the top margin P1 was smaller than 2.5 mm, whereas the wrapping phenomenon did not occur when the minimum width L of the top margin P1 was equal to or larger than 2.5 mm.

FIG. 4 is a graphical representation of the experimental results concerning the occurrence of the wrapping phenomenon in relation to the gap d (mm) between the far end S of the separating plate 34 and the surface of the fixing belt 32 shown on a horizontal axis and the minimum width L (mm) of the top margin P1 of the sheet P shown on a vertical axis. The experimental results indicated that the wrapping phenomenon would not occur at least in a hatched area shown in FIG. 4.

A straight line M1 shown in FIG. 4 is a border line between an area in which the wrapping phenomenon occurs and an area in which the wrapping phenomenon does not occur when the distance r from the downstream end N2 of the fixing nip portion N to the far end S of the separating plate 34 is set to 3.7 mm. The straight line M1 can approximately be expressed by equation (3) below:

$$L = d + 1.5 \quad (3)$$

In this experiment, the wrapping of the sheet P did not occur in the area above the straight line M1 while the wrapping occurred in the area below the straight line M1. Equation (3) above defines a lower limit of the minimum width L of the top margin P1 when the gap d formed at the far end S of the separating plate 34 is varied.

On the other hand, a straight line M2 shown in FIG. 4 is a border line between an area in which the wrapping phenomenon occurs and an area in which the wrapping phenomenon does not occur when the distance r from the downstream end N2 of the fixing nip portion N to the far end S of the separating plate 34 is set to 8.3 mm. The straight line M2 can approximately be expressed by equation (4) below:

$$L = 3d + 1.5 \quad (4)$$

The wrapping of the sheet P occurred in the area above the straight line M2 while the wrapping did not occur in the area below the straight line M2 in the experiment. Equation (4)

above defines an upper limit of the minimum width L of the top margin P1 when the gap d formed at the far end S of the separating plate 34 is varied.

Even in an area between the straight line M1 defined by equation (3) above and the straight line M2 defined by equation (4) above, below-described problems may occur if the gap d formed at the far end S of the separating plate 34 is in regions expressed by the following inequalities:

$$d<0.3,\ d>0.6 \tag{5}$$

Specifically, if d<0.3, a buildup of paper dust or residual toner particles on the far end S of the separating plate 34 is likely to damage the surface of the fixing belt 32. If d>0.6, on the other hand, the wrapping phenomenon may potentially occur when the sheet P is as thin as 60 g/m$^2$ or less due to extremely low stiffness.

Based on the aforementioned experimental results, the inventor determined preferable ranges of the gap d between the far end S of the separating plate 34 and the surface of the fixing belt 32 and the minimum width L of the top margin P1 of the sheet P in this embodiment as follows:

$$d+1.5 \leqq L \leqq 3d+1.5 \tag{6}$$

$$0.3 \leqq d \leqq 0.6 \tag{7}$$

If the gap d formed at the far end S of the separating plate 34, the minimum width L of the top margin P1 and the distance r from the downstream end N2 of the fixing nip portion N to the far end S of the separating plate 34 are set to fall in the ranges defined by the aforementioned inequalities (2), (6) and (7), it is possible to separate the sheet P carrying the fixed toner image t from the fixing belt 32 in a reliable fashion and thus prevent the sheet P from wrapping around the fixing belt 32 even when variations occur in the width of the top margin P1.

The above-described approach of the embodiment is to reliably separate the sheet P carrying the fixed toner image t from the fixing belt 32 by setting the gap d formed at the far end S of the separating plate 34, the minimum width L of the top margin P1 and the distance r from the downstream end N2 of the fixing nip portion N to the far end S of the separating plate 34 to satisfy relationships of inequalities (2), (6) and (7) above. It is to be pointed out however that the invention is not limited to this approach. For example, it is possible to achieve an improved sheet separating capability by setting the gap d and the minimum width L of the top margin P1 to satisfy at least the relationship of inequality (6) above, compared to a case where this relationship is not satisfied.

While the invention has thus far been described by way of example, with reference to the preferred embodiment, the invention is not limited thereto, but the above-described arrangement of the embodiment may be modified in various ways. Described below are examples of modifications of the foregoing embodiment.

Figure 8A:
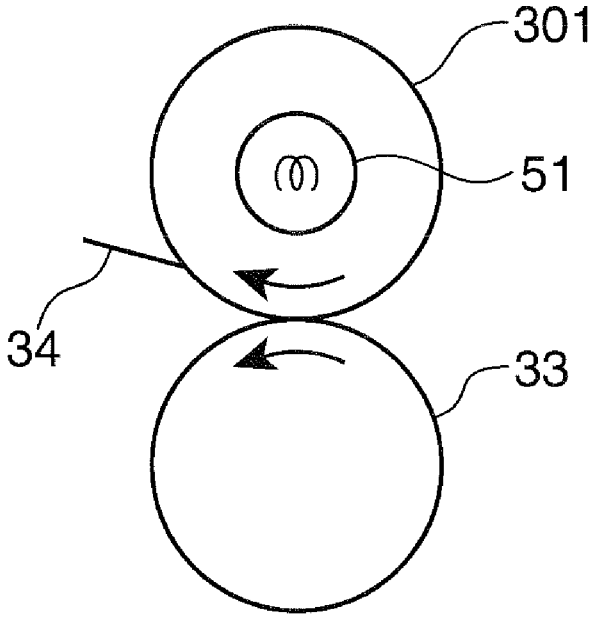
FIGS. 8A, 8B, 9A, 9B, 10, 11A, 11B, 12A, 12B and 13 are diagrams showing fixing units according to modified embodiments of the invention.
Figure 8B:
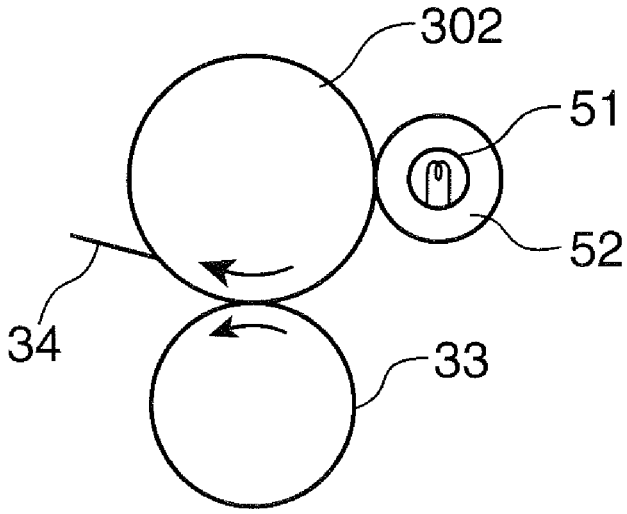

[1] In the fixing unit 1 of the foregoing embodiment of the invention, the fixing belt 32 constitutes the pressing rotary member. This arrangement of the embodiment may be modified such that a fixing roller 301 incorporating a heating element, such as a halogen heater 51, is pressed directly against the pressure roller 33 without use of the fixing belt 32 as shown in FIG. 8A, in which the separating plate 34 is disposed in the same way as in the foregoing embodiment. Alternatively, the arrangement of the foregoing embodiment may be modified such that a heating roller 52 incorporating a halogen heater 51 is held in contact with a curved outer surface of a fixing roller 302 which is not provided with any heating element as shown in FIG. 8B.

Figure 9A:
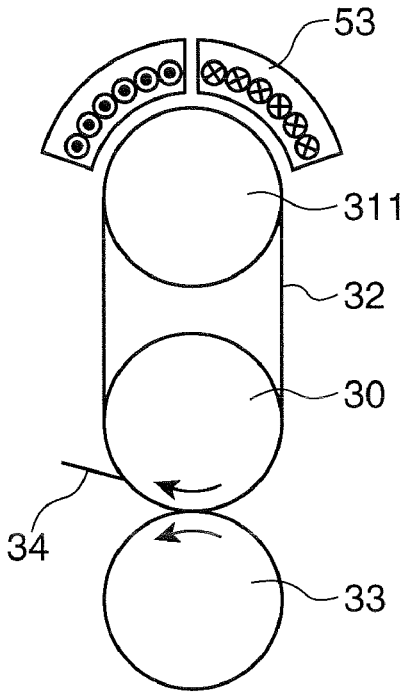
Figure 9B:
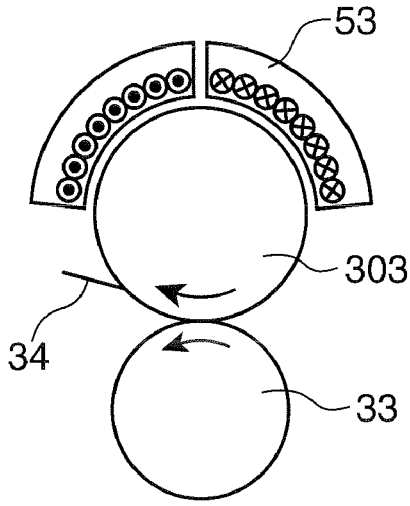

[2] Needless to say, the invention is also applicable to an induction heating type fixing unit of which examples are shown in FIGS. 9A and 9B. An arrangement shown in FIG. 9A includes a fixing belt 32 and an induction heating coil 53 disposed face to face with a curved outer surface of a supporting roller 311 to heat the fixing belt 32 by electromagnetic induction. An arrangement shown in FIG. 9B does not employ the fixing belt 32. Instead, this arrangement includes a fixing roller 303 which can be heated by electromagnetic induction and an induction heating coil 53 disposed face to face with a curved outer surface of the fixing roller 303.

Figure 10:
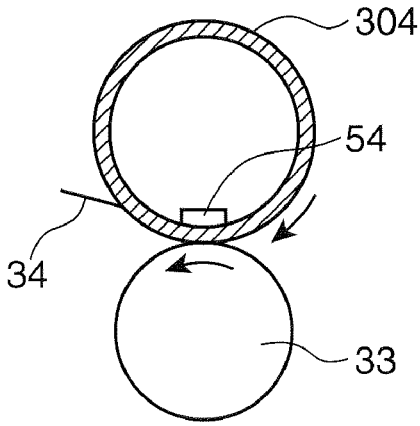

[3] The invention is also applicable to a fixing unit configured as illustrated in FIG. 10. Specifically, this fixing unit includes a one-piece fixing belt 304 serving as a heating rotary member and a heating device 54 including a ceramic heater array, for instance.

Figure 11A:
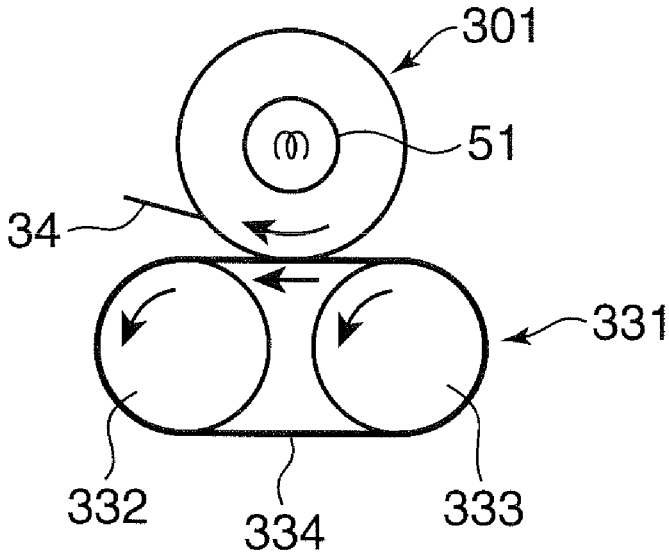
Figure 11B:
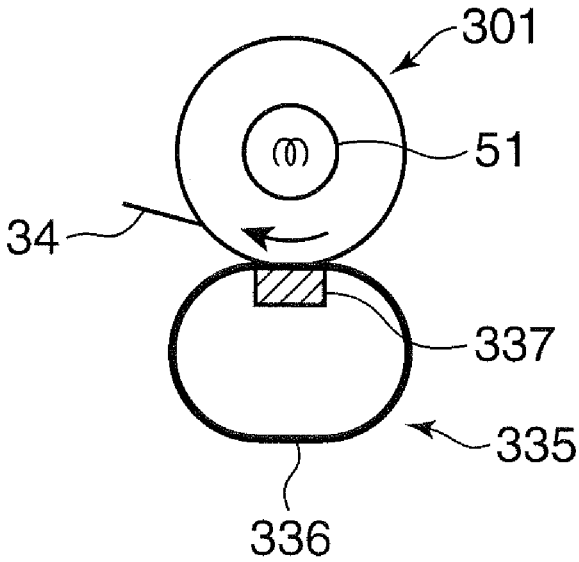

[4] Furthermore, the image processing apparatus 2 may employ a fixing unit which includes instead of the pressure roller 33 shown in FIG. 8A a pressing unit 331 including a pair of rollers 332, 333 and an endless pressure belt 334 mounted on the two rollers 332, 333 as illustrated in FIG. 11A. Alternatively, the image processing apparatus 2 may employ a fixing unit which includes instead of the pressure roller 33 a pressing unit 335 including an endless pressure belt 336 and a pressure pad 337 as illustrated in FIG. 11B.

Figure 12A:
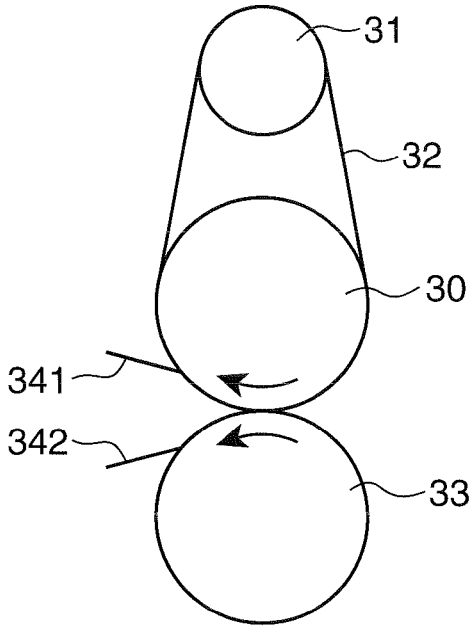
Figure 12B:
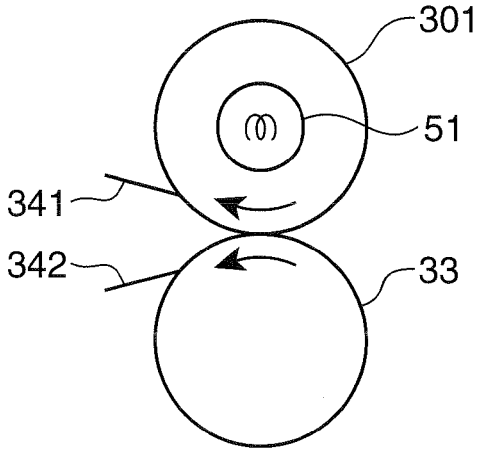

[5] While the fixing unit 1 of the foregoing preferred embodiment is an example in which only the fixing belt 32 is provided with the separating plate 34, the invention is not limited to this arrangement, but the pressure roller 33 may also be provided with a separating plate. Shown in FIG. 12A is an example in which the fixing belt 32 is provided with a first separating plate 341 while the pressure roller 33 is provided with a second separating plate 342. Shown in FIG. 12B is an example in which the fixing roller 301 is provided with a first separating plate 341 while the pressure roller 33 is provided with a second separating plate 342.

Figure 13:
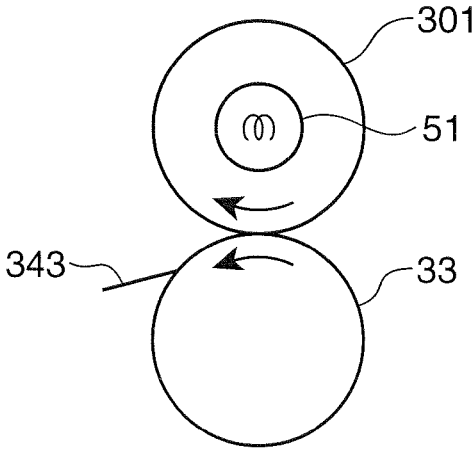

In a fixing unit of an image forming apparatus having a duplex printing capability, a side of the sheet P carrying the fixed toner image t can face the pressure roller 33, so that the sheet P may wrap around the pressure roller 33. If the pressure roller 33 is provided with the second separating plate 342 as illustrated in FIGS. 12A and 12B, it is possible to separate the sheet P even when the sheet P adheres to the pressure roller 33. Alternatively, only the pressure roller 33 may be provided with a separating plate 343 as shown in FIG. 13 if the fixing roller 301 is provided with a dedicated sheet separating mechanism.

[6] The above-described construction of the image forming apparatus 2 is simply illustrative of the invention. The fixing units of the foregoing embodiment and modifications thereof can be implemented in any type of image forming apparatus which is configured to apply heat and pressure to an unfixed toner image formed on a sheet so that the toner image partially melts and sticks to the sheet. For example, the above-described arrangements of the invention are applicable to an intermediate transfer type image forming apparatus in which a toner image formed on a photosensitive drum is transferred to an intermediate transfer member (e.g. an intermediate transfer belt) and then to a sheet, as well as to a color image forming apparatus configured to produce a color image by using plural color toners.

[7] Moreover, the invention is widely applicable not only to apparatuses configured to fix a toner image to a sheet but also to apparatuses configured to partially melt and fix a thin layer of a hot-melt material to a surface of a sheetlike medium. For example, the invention is also applicable to a sheet processing apparatus having first and second rotary members configured to form a synthetic resin layer on one or both sides of a sheet in an area excluding a portion corresponding to a top margin and fuse the synthetic resin layer to the sheet by application of heat and pressure.

In summary, a fixing unit according to a first aspect of the invention comprises a heating rotary member for heating a sheet, a pressing rotary member which is pressed against the heating rotary member with a specific pressure, forming a nip portion in between, and at least one separating member having a far end directed toward a surface of one of the rotary members with a narrow gap d on a downstream side of the nip portion so that the far end of the separating member hooks on and separates the sheet which is going to turn with the aforementioned one of the rotary members. In this fixing unit of the invention, the gap d (mm) between the far end of the separating member and the surface of the aforementioned one of the rotary members and a minimum width L (mm) of a top margin of the sheet along a leading edge thereof where no toner image is formed are set to satisfy a relationship expressed by the following inequality:

$$d+1.5 \leqq L \leqq 3d+1.5.$$

An image forming apparatus according to a second aspect of the invention comprises a sheet transport section for transporting a sheet, an image forming section for forming a toner image on the sheet transported by the sheet transport section, and a fixing section for partially melting and fixing the toner image formed on the sheet by the image forming section to a surface of the sheet by application of heat and pressure, wherein the fixing section in configured in the same fashion as the aforementioned fixing unit according to the first aspect.

According to the fixing unit and the image forming apparatus of the invention thus configured, it is possible to separate the sheet which is going to wrap around and turn with one of the rotary members by setting the gap d (mm) and the width L (mm) of the top margin to satisfy the inequality $d+1.5 \leqq L \leqq 3d+1.5$ so that the far end of the separating member hooks on the top margin of the sheet in a reliable fashion even when variations occur in the width of the top margin. As mentioned in the foregoing detailed description, the inequality $d+1.5 \leqq L \leqq 3d+1.5$ above expresses the experimentally obtained relationship.

In one feature of the invention, a distance r (mm) from a downstream end of the nip portion to the far end of the separating member and the gap d (mm) are set to fall within the following ranges:

$$3.7 \leqq r \leqq 8.3;$$

$$0.3 \leqq d \leqq 0.6.$$

If the far end of the separating member is positioned so that the distance r (mm) and the gap d (mm) fall within the ranges defined by $3.7 \leqq r \leqq 8.3$ and $0.3 \leqq d \leqq 0.6$, respectively, it is possible to separate the sheet from the aforementioned one of the rotary members in a more reliable fashion.

In another feature of the invention, the heating rotary member includes a fixing belt which is mounted on a fixing roller and a heating roller, wherein the fixing roller is forced against the pressing rotary member. Alternatively, the heating rotary member includes a fixing roller provided with a heating element.

Preferably, the fixing unit of the invention further comprises an adjustment mechanism which makes it possible to adjust the location of the far end of the separating member relative to the aforementioned one of the rotary members.

In the fixing unit thus configured, the adjustment mechanism preferably includes a supporting arm for movably supporting the separating member.

Alternatively, the adjustment mechanism preferably includes a supporting arm for supporting the separating member movably along the surface of the aforementioned one of the rotary members on the downstream side of the nip portion, and a spacer for determining the gap between the far end of the separating member and the surface of the aforementioned one of the rotary members.

These arrangements make it possible to adjust the gap between the far end of the separating member and the surface of the aforementioned one of the rotary members with ease and high accuracy.

In still another feature of the invention, the fixing unit of the invention further comprises an element having an excellent release characteristic provided on the far end of the separating member at a portion thereof which goes into contact with the sheet. This arrangement is preferable in that the separating member can reliably separate the sheet since the leading edge of the sheet which goes into contact with the far end of the separating member smoothly slides without being caught thereby.

According to a third aspect of the invention, a sheet processing apparatus for partially melting and fixing a thin layer of a hot-melt material formed on a surface of a sheet to the surface of the sheet by application of heat and pressure comprises first and second rotary members which are pressed against each other with a specific pressure, forming a nip portion in between, whereby the first and second rotary members together pass the sheet through the nip portion while heating and pressing the sheet, and at least one separating member having a far end directed toward a surface of one of the first and second rotary members with a narrow gap d on a downstream side of the nip portion so that the far end of the separating member hooks on and separates the sheet which is going to turn with the aforementioned one of the first and second rotary members. In this sheet processing apparatus of the invention, the gap d (mm) between the far end of the separating member and the surface of the aforementioned one of the first and second rotary members and a minimum width L (mm) of a top margin of the sheet along a leading edge thereof where the thin layer of the hot-melt material is not formed are set to satisfy a relationship expressed by the following inequality:

$$d+1.5 \leqq L \leqq 3d+1.5.$$

The sheet processing apparatus thus configured can separate the sheet which is going to wrap around and turn with one of the first and second rotary members by hooking the far end of the separating member on the top margin of the sheet where the thin layer of the hot-melt material is not formed.

This application is based on patent application No. 2006-322110 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixing unit for partially melting and fixing an unfixed toner image formed on a surface of a sheet to the surface of the sheet by application of heat and pressure, said fixing unit comprising:

a heating rotary member for heating the sheet;

a pressing rotary member which is pressed against said heating rotary member with a specific pressure, forming a nip portion in between; and at least one separating member having a far end directed toward a surface of one of said rotary members with a narrow gap d on a downstream side of the nip portion so that the far end of said separating member hooks on and separates the sheet which is going to turn with said one of said rotary members;

wherein the gap d (mm) between the far end of said separating member and the surface of said one of said rotary members and a minimum width L (mm) of a top margin of the sheet along a leading edge thereof where the toner image is not formed are set to satisfy a relationship expressed by the following inequality:

$$d+1.5 \leqq L \leqq 3d+1.5.$$

and wherein a distance r (mm) from a downstream end of the nip portion to the far end of said separating member and said gap d (mm) are set to fall within the following ranges:

$$3.7 \leqq r \leqq 8.3;$$

$$0.3 \leqq d \leqq 0.6.$$

2. The fixing unit according to claim 1, wherein said heating rotary member includes a fixing belt which is mounted on a fixing roller and a heating roller, and said fixing roller is forced against said pressing rotary member.

3. The fixing unit according to claim 1, wherein said heating rotary member includes a fixing roller provided with a heating element.

4. The fixing unit according to claim 1 further comprising an adjustment mechanism which makes it possible to adjust the location of the far end of said separating member relative to said one of said rotary members.

5. The fixing unit according to claim 4, wherein said adjustment mechanism includes a supporting arm for movably supporting said separating member.

6. The fixing unit according to claim 4, wherein said adjustment mechanism includes:

a supporting arm for supporting said separating member movably along the surface of said one of said rotary members on the downstream side of the nip portion; and a spacer for determining the gap between the far end of said separating member and the surface of said one of said rotary members.

7. The fixing unit according to claim 1 further comprising an element having an excellent release characteristic provided on the far end of said separating member at a portion thereof which goes into contact with the sheet.

8. An image forming apparatus comprising:

a sheet transport section for transporting a sheet;

an image forming section for forming a toner image on the sheet transported by said sheet transport section; and a fixing section for partially melting and fixing the toner image formed on the sheet by said image forming section to a surface of the sheet by application of heat and pressure, said fixing section including:

a heating rotary member for heating the sheet;

a pressing rotary member which is pressed against said heating rotary member with a specific pressure, forming a nip portion in between; and at least one separating member having a far end directed toward a surface of one of said rotary members with a narrow gap d on a downstream side of the nip portion so that the far end of said separating member hooks on and separates the sheet which is going to turn with said one of said rotary members;

wherein the gap d (mm) between the far end of said separating member and the surface of said one of said rotary members and a minimum width L (mm) of a top margin of the sheet along a leading edge thereof where the toner image is not formed are set to satisfy a relationship expressed by the following inequality:

$$d+1.5 \leqq L \leqq 3d+1.5.$$

and wherein a distance r (mm) from a downstream end of the nip portion to the far end of said separating member and said gap d (mm) are set to fall within the following ranges:

$$3.7 \leqq r \leqq 8.3;$$

$$0.3 \leqq d \leqq 0.6.$$

9. The image forming apparatus according to claim 8, wherein said heating rotary member includes a fixing belt which is mounted on a fixing roller and a heating roller, and said fixing roller is forced against said pressing rotary member.

10. The image forming apparatus according to claim 8, wherein said heating rotary member includes a fixing roller provided with a heating element.

11. The image forming apparatus claim 8 further comprising an adjustment mechanism which makes it possible to adjust the location of the far end of said separating member relative to said one of said rotary members.

12. The image forming apparatus according to claim 11, wherein said adjustment mechanism includes a supporting arm for movably supporting said separating member.

13. The image forming apparatus according to claim 11, wherein said adjustment mechanism includes:

a supporting arm for supporting said separating member movably along the surface of said one of said rotary members on the downstream side of the nip portion; and a spacer for determining the gap between the far end of said separating member and the surface of said one of said rotary members.

14. The image forming apparatus claim 8 further comprising an element having an excellent release characteristic provided on the far end of said separating member at a portion thereof which goes into contact with the sheet.

15. A sheet processing apparatus for partially melting and fixing a thin layer of a hot-melt material formed on a surface of a sheet to the surface of the sheet by application of heat and pressure, said sheet processing apparatus comprising:

first and second rotary members which are pressed against each other with a specific pressure, forming a nip portion in between, whereby said first and second rotary members together pass the sheet through the nip portion while heating and pressing the sheet; and at least one separating member having a far end directed toward a surface of one of said first and second rotary members with a narrow gap d on a downstream side of the nip portion so that the far end of said separating member hooks on and separates the sheet which is going to turn with said one of said first and second rotary members;

wherein the gap d (mm) between the far end of said separating member and the surface of said one of said first and second rotary members and a minimum width L (mm) of a top margin of the sheet along a leading edge thereof where the thin layer of the hot-melt material is not formed are set to satisfy a relationship expressed by the following inequality:

$$d+1.5 \leqq L \leqq 3d+1.5.$$

and wherein a distance r (mm) from a downstream end of the nip portion to the far end of said separating member and said gap d (mm) are set to fall within the following ranges:

$$3.7 \leqq r \leqq 8.3;$$

$$0.3 \leqq d \leqq 0.6.$$

* * * * *